United States Patent [19]

Kato et al.

[11] 4,420,334

[45] Dec. 13, 1983

[54] METHOD FOR CONTROLLING THE BOTTOM-BLOWING GAS IN TOP-AND-BOTTOM BLOWN CONVERTER STEEL MAKING

[75] Inventors: Yoshiei Kato; Kyoji Nakanishi; Tsutomu Nozaki, all of Chiba, Japan

[73] Assignee: Kawasaki Steel Corporation, Kobe, Japan

[21] Appl. No.: 385,408

[22] PCT Filed: Sep. 19, 1981

[86] PCT No.: PCT/JP81/00240

§ 371 Date: May 17, 1982

§ 102(e) Date: May 17, 1982

[87] PCT Pub. No.: WO82/01013

PCT Pub. Date: Apr. 1, 1982

[30] Foreign Application Priority Data

Sep. 19, 1980 [JP] Japan ..... 55-131403

[51] Int. Cl.[3] ..... C21C 5/32; C21C 5/34

[52] U.S. Cl. ..... 75/60; 75/59

[58] Field of Search ..... 75/52, 59, 60

[56] References Cited

U.S. PATENT DOCUMENTS

| | | | |
|---|---|---|---|
| 3,046,107 | 7/1962 | Nelson | 75/59 |
| 3,854,932 | 12/1974 | Bishop | 75/60 |
| 4,280,838 | 7/1981 | Masukawa | 75/52 |
| 4,334,921 | 6/1982 | Herai | 75/60 |

*Primary Examiner*—Peter D. Rosenberg

*Attorney, Agent, or Firm*—Wenderoth, Lind & Ponack

[57] ABSTRACT

A method is provided for alternately changing the bottom-blowing gas between an oxidizing gas and an inert gas in top-and-bottom blown converter steel making. The bottom-blowing gas is changed to the oxidizing as when the blowing gas pressure rises to a certain level during the supply of the inert gas as the bottom-blowing gas, whereas the bottom-blowing gas is changed to the inert gas when the blowing gas pressure drops to another level during the supply of the oxidizing gas. This prevents the nozzle blocking and the melt-off of the tuyere at the same time.

4 Claims, 1 Drawing Figure

METHOD FOR CONTROLLING THE BOTTOM-BLOWING GAS IN TOP-AND-BOTTOM BLOWN CONVERTER STEEL MAKING

DESCRIPTION

1. Technical Field

This invention relates to top-and-bottom blown converter steel making of the type wherein an oxidizing gas such as pure oxygen is blown onto the surface of molten iron in the converter through a lance disposed above the molten iron surface while an oxidizing or inert gas is blown into the molten steel through a tuyere arranged at the bottom of the converter, and more particularly, to a method for changing the kind of the bottom-blowing gas in accordance with a variation in the pressure of the bottom-blowing gas during refining in a controlled manner.

1. Background Art

In order to enhance the agitation of molten iron in an oxygen top-blown converter, i.e., LD converter an a method was developed for blowing an oxidizing or inert gas into the molten iron through a tuyere provided at the bottom for bottom of the converter blowing while blowing an oxidizing gas onto the molten iron surface through a lance. Since such top-and-bottom blown converter steel making affords an improved agitation effect as compared with the top-blown converter steel making, the concentration of iron (T.Fe) in the slag is prevented from increasing during a low carbon period in the final stage of blowing as in top-blown converters, and an outstanding improvement is thus achieved in the yield of iron over top-blown converters.

When an inert gas such as argon gas is used as the bottom-blowing gas in the above-described top-and-bottom blown converter, iron will coagulate at and adhere to the tip of the tuyere because of cooling due to the sensible heat of the inert gas so that the nozzle of the tuyere is gradually blocked, which leads to the problem that the flow rate of the gas is reduced to below that required for the agitation of molten iron. Specifically, the above-described nozzle blockage becomes more severe with time and reduces the flow rate of the bottom-blowing gas in the final stage of blowing which particularly requires agitation to improve the iron yield, and as a result, in some cases, the effect of preventing the increase of the iron value concentration of a slag by bottom blowing to improve the iron yield is not achieved at all.

On the other hand, when an oxidizing gas is used as the bottom-blowing gas, the tuyere tip is heated to elevated temperatures due to the exothermic reaction of the oxidizing gas with carbon, silicon, iron or the like in the molten iron, which leads to the problem that the tuyere is melted off. This problem could be overcome by using a bottom-blowing tuyere having a double pipe structure as in the bottom-blown converter (oxygen bottom-blown converter, Q-BOP) in which an oxidizing gas is blown into the inner pipe and a gas for cooling the tuyere, for example, a hydrocarbon gas, is introduced into the passage between the outer and inner pipes, although this leads to the problem that not only the cost of the tuyere, but also the total amount of gas used and hence, the operating cost are increased.

It is, therefore, an object of this invention to overcome both the above-described problems of nozzle blockage and tuyere melt-off without using a double-pipe tuyere, and to achieve an improvement in the iron yield attributable to the enhanced agitation in the top-and-bottom blown converter while avoiding any increase in the tuyere cost and gas use.

DISCLOSURE OF INVENTION

The method for controlling the bottom-blowing gas in top-and-bottom blown converter steel making according to this invention comprises detecting the pressure of the gas supplied to the bottom-blowing tuyere, changing the gas supplied to the bottom-blowing tuyere to an oxidizing gas containing at least 60% of oxygen gas when the pressure of the inert gas rises and reaches the upper limit of a predetermined pressure range during the supply of the inert gas to the bottom-blowing tuyere, and changing the gas supplied to the bottom-blowing tuyere to the inert gas when the pressure of the oxidizing gas drops and reaches the lower limit of said predetermined pressure range during the supply of the oxidizing gas to the bottom-blowing tuyere, thereby alternately supplying the oxidizing gas and the inert gas to the bottom-blowing tuyere. The nozzle blocking is avoided due to the exothermic reaction of the oxidizing gas by changing the gas to the oxidizing gas when it is detected that the pressure of the inert gas rises to the predetermined upper limit during the supply of the inert gas, while the melt-off of the tuyere is prevented by changing the gas to the inert gas when it is detected by changing the gas to the inert gas when it is detected that the pressure of the oxidizing gas drops to the predetermined lower limit during the supply of the oxidizing gas. Consequently, the method of this invention can prevent both the nozzle blocking and melt-off of the bottom-blowing tuyere. Further, the prevention of nozzle blocking avoids any reduction in the flow rate of the bottom-blowing gas, and as a result, the enhanced agitation effect of the bottom-blowing gas is exerted even in the final stage of blowing to prevent the concentration of iron in the slag from increasing. As the melt-off of the tuyere is prevented as described above, not only is the lifespan of the tuyere prolonged, but also the need for a double pipe tuyere is eliminated, reducing the tuyere cost and gas use. In addition, since the gas flow rate may be kept substantially at a fixed level, the gas flow rate may be set to the optimum level for obtaining the best metallurgical effect and minimizing the amount of gas used, thereby achieving a reduction of gas use and obtaining an increased metallugrical effect at the same time.

Furthermore, since an oxygen-rich gas containing at least 60% of oxygen is used as the oxidizing gas, an abrupt exothermic reaction occurs between the oxidizing gas and oxidizable elements in the molten steel, for example, C, Si, Mn, Fe, etc. when the gas is changed from the inert gas to the oxidizing gas, and this exothermic reaction causes the coagulated iron in the proximity of the nozzle tip of the tuyere to rapidly melt, thereby obviating the nozzle blocking propensity within a short period of time.

BEST MODE FOR CARRYING OUT THE INVENTION

Figure 1:
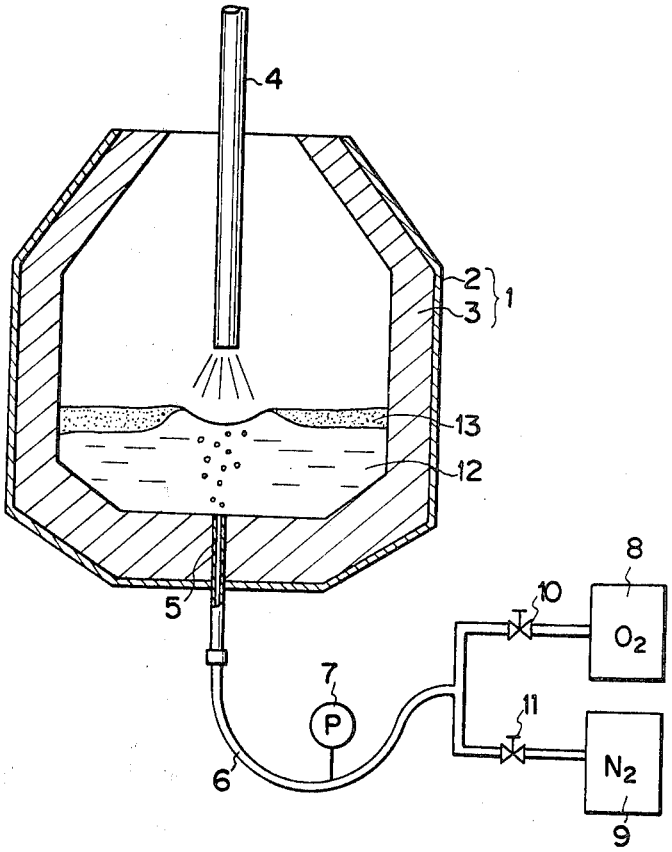
FIG. 1 is a schematic view showing a top-and-bottom blown converter with a bottom-blowing gas supply system for carrying out the bottom-blowing gas controlling method of this invention.

The control method of this invention will be described in detail with reference to FIG 1.

A converter housing 1 which consists of an outer shell 2 of steel lined with a refractory 3, for example, brick, has an upper opening through which a lance 4 is inserted into the converter housing for blowing an oxidizing gas, for example, pure oxygen, therein, and is provided at the bottom with a tuyere 5 of a single pipe structure for bottom blowing. A supply conduit 6 is connected to the bottom-blowing tuyere 5 outside the converter and includes a pressure detector 7, for example, in the form of a pressure gauge for detecting the pressur of a gas supplied to the bottom-blowing tuyere 5, and this supply conduit 6 is connected to oxidizing gas and inert gas sources 8 and 9 via valves 10 and 11, respectively. It is to be noted that in FIG. 1, 12 designates molten iron and 13 designates a slag layer on the molten iron surface.

With the arrangement shown, if the valve 11 is opened and the valve 10 is closed at the beginning of blowing, an inert gas, for example, nitrogen or argon gas, is supplied from the insert gas source 9 to the bottom-blowing tuyere 5 through the valve 11 and the supply conduit 6 and then blown into the molten steel 12. Under this condition, iron gradually coagulates at and adheres to the tip of the tuyere 5 by cooling due to the sensible heat of the inert gas as described above, and as a result, the opening in the tip of the tuyere 5 is gradually reduced in cross section so that the gas pressure is gradually increased. The gas pressure would be further increased to considerably reduce the flow rate of gas if this system remained unchanged. However, according to this invention, when the gas pressure detected by the pressure detector 7 reaches the upper limit of a predetermined pressure range, the gas supplied to the bottom-blowing tuyere 5 is changed to an oxidizing gas, for example, pure oxygen or an oxidizing gas containing at least 60% of oxygen, for example, a gas mixture of oxygen gas with nitrogen or argon gas or the like. Specifically, in the illustrated embodiment, the valve 10 is opened and the valve 11 is closed, thereby changing the system such that pure oxygen or oxidizing gas such as oxygen containing gas from the oxidizing gas source 8 is supplied to the bottom-blowing tuyere 5 through the valve 10 and the supply conduit 6. Then, the solidified iron which has coagulated at and adhered to the tip of the bottom-blowing tuyere 5 as a result of the above-described inert gas blowing is melted by the exothermic reaction of the oxidizing gas, that is, the exothermic reaction of the oxidizing gas with oxidizable elements in the molten iron, for example, Si, C, Mn, Fe, etc., so that the opening in the tip of the tuyere 5 is gradually increased in cross section to restore the gas pressure to the initial value. Consequently, the gas flow rate is prevented from decreasing to below a certain level. If the supply of oxidizing gas is further continued, the above-mentioned exothermic reaction would cause the tuyere to be melted off to increase the cross section of the opening of the tuyere, thereby further reducing the gas pressure, and sometimes causing the so-called burn-back phenomenon in which the tuyere portion is considerably retracted from the surface of the refractory adjacent the tuyere. However, according to this invention, when the gas pressure which is decreasing during the supply of oxidizing gas reaches the lower limit of the above-described predetermined pressure range, the gas supplied to the bottom-blowing tuyere 5 is changed again to the inert gas. In the illustrated embodiment, the valve 11 is opened and the valve 10 is closed. This prevents the tuyere 5 from being further melted off. The gas pressure rises again in this condition as described above. Then, the above-described changing operation is alternately repeated.

By changing the gas supplied to the bottom-blowing tuyere 5 alternately between the oxidizing gas and the inert gas each time when the pressure of the respective gases reaches the upper and lower limits of the predetermined gas pressure range, the gas pressure can be varied substantially within the range defined between the upper and the lower limits, and consequently, the gas flow rate will not be widely varied and is maintained within a certain range. The nozzle blocking and melt-off of the tuyere can be prohibited at the same time.

Gases having lower contents of $O_2$, for example, air might be used as the oxidizing gas to be blown through the bottom-blowing tuyere. However, when such oxidizing gases having lower oxygen contents, for example, about 20% of $O_2$, are used, it is difficult to obviate the propensity toward nozzle blocking within a short period of time. Since this invention concerns a technique for smoothly performing refining in a refining process from the start to the end thereof, it is required that the nozzle blocking propensity be obviated within a short period of time. To this end, the $O_2$ content of the oxidizing gas used is preferably as high as possible. Experiments have shown that oxidizing gases containing at least 60% of $O_2$ must be used, and oxidizing gases containing 80% or more of $O_2$ are preferably used.

It wil be understood that the upper and lower limits of the pressure of the gas to be supplied to the bottom-blowing tuyere are, of course, set to values at which the invasion of molten iron into the tuyere is precluded. Although the difference between the upper and lower limits is preferably as low as possible in order to keep the gas flow rate constant, an extremely small difference would require frequent gas changes and cause a complicated operation and lead to the risk of reducing the life of the changeover means including the valves. Experiments have shown that it is desirable to set the upper and lower limits within the range of $\pm 0.3$ kg/cm$^2$ with respect to a center value. Further, in order to prevent the gas pressure from instantaneously dropping down when changing the gas, one valve is opened before the other valve is closed. It is, of course, desired to automatically carry out the changing operation or valve actuation in response to an electrical signal from the pressure detector. It is unnecessary to fix the upper and lower limits of the gas pressure from the start to the end of blowing, and in some cases, they may optionally be varied in an intermediate stage of blowing. More particularly, a moderate agitation effect by bottom blowing may suffice in the initial and intermediate stages of blowing which mainly contribute to decarbonization and dephosphorization, while it is desired to enhance the agitation effect by bottom blowing to reduce the concentration of iron value (T.Fe) in the slag to lower than in the case of LD converters in the final stage of blowing. Accordingly, the flow rate of gas may be set to a lower level sufficient to prevent the invasion of molten iron into the tuyere in the initial and intermediate stages of blowing, and it may then be increased to enhance the agitation effect in the final stage of blowing. In this case, the upper and lower limits of the gas pressure may be set to lower levels in the initial and intermediate stages and then reset to higher levels in the final stage of blowing as done in Run Nos. 5 and 6 in the Example described later.

The bottom-blowing tuyere is subject to nozzle blocking particularly when it as a smaller inner diameter. Since the tuyere with a small inner diameter exhibits a pronounced pressure variation during the nozzle blocking process, the nozzle blocking may be precisely monitored when the inner diameter of the tuyere is small. From these points of view, the bottom-blowing gas control method of this invention is most effective and useful when the tuyere has a small inner diameter, and generally when the tuyere has an inner diameter of about 6 mm or smaller.

This invention is not limited to a converter with a single bottom-blowing tuyere, but is applicable to converters having two or more tuyeres. In the case of plural tuyeres, the bottom-blowing gas flows through the respective tuyeres may be independently controlled, or all the tuyeres may be controlled at the same time, or alternatively, a plurality of tuyeres may be divided into groups and the bottom-blowing gas may be controlled for each group.

Examples and Comparative Examples of this invention are shown below.

EXAMPLE

Blowing was effected on molten iron in a 5-ton top-and-bottom blown converter as shown in FIG. 1, by blowing pure oxygen through the lance at 15 $Nm^3$/min. and by blowing pure oxygen (or a mixture of oxygen and nitrogen gases) and nitrogen sequentially and alternately through the bottom-blowing tuyere. The lance used was of a laval type having four ports and a nozzle (throat) diameter of 12 mm. The bottom-blowing tuyere was a single pipe of stainless steel having an inner diameter of 4 mm. The preset pressure range of the bottom-blowing gas, average flow rate of the bottom-blowing gas, molten metal composition, blowing-out composition and blowing-out temperature in this example are shown in Table 1, and the sequence of changing the bottom-blowing gas is shown in Table 2. It is to be noted in Table 2 that the time (min.) shown in Table 2 is the length of time from the start of blowing to the respective changes. Among Runs Nos. 1–7 in this example, pure oxygen ($O_2$ gas) was used as the bottom-blowing oxidizing gas in Runs Nos. 1–6 and a mixture of oxygen ($O_2$) and nitrogen ($N_2$) at a ratio of 6:4 was used as the bottom-blowing oxidizing gas in Run No. 7. In Runs Nos. 5 and 6 among Runs Nos. 1–7, the flow rate of the bottom-blowing gas was set to 0.3 $Nm^3$/min. and the predetermined gas pressure range was from 1.9 to 2.1 $kg/cm^2$.G until 14 minutes had passed from the start of blowing, and then the flow rate of the bottom-blowing gas was reset to 1.0 $Nm^3$/min. and the gas pressure range was reset to from 3.0 to 3.2 $kg/cm^2$.G until the blowing was completed (16 minutes had passed).

COMPARATIVE EXAMPLE 1

In a converter equipped with a lance as described in the foregoing, molten iron was subjected to blowing by using the top-blowing pure oxygen only. The flow rate of the top-blowing gas was 15 $Nm^3$/min. as in the Example and the blowing time was 15 minutes.

COMPARATIVE EXAMPLE 2

In a converter equipped with a lance as described above, pure oxygen gas was blown through the lance at a flow rate of 15 $Nm^3$/min. and only nitrogen gas was blown through the bottom-blowing tuyere at an initial flow rate of 1.0 $Nm^3$/min. and this flow rate was continued until the end of blowing.

The molten metal composition, blowing-out composition in Comparative Examples 1 and 2 are shown in the lower portion of Tables 1 and 2.

TABLE 1

| | Run No. | Bottom-blowing gas flow rate ($Nm^3$/min.) | Bottom-blowing gas pressure ($kg/cm^2 \cdot G$) | Molten metal composition C (%) | Molten metal composition P (%) | Blowing-out composition C (%) | Blowing-out composition P (%) | Blowing-out composition T.Fe (%) | Blowing-out temperature (°C.) |
|---|---|---|---|---|---|---|---|---|---|
| Example | 1 | 0.6 | 2.4–2.6 | 4.47 | 0.111 | 0.02 | 0.014 | 17.4 | 1607 |
| | 2 | 0.6 | 2.4–2.6 | 4.61 | 0.130 | 0.06 | 0.018 | 18.1 | 1594 |
| | 3 | 1.0 | 3.0–3.2 | 4.38 | 0.122 | 0.01 | 0.009 | 17.2 | 1613 |
| | 4 | 1.0 | 3.0–3.2 | 4.45 | 0.128 | 0.02 | 0.013 | 16.9 | 1604 |
| | 5 | 0.3 | 1.9–2.1 | | | | | | |
| | | 1.0 | 3.0–3.2 | 4.34 | 0.117 | 0.03 | 0.017 | 17.1 | 1608 |
| | | 0.3 | 1.9–2.1 | | | | | | |
| | 6 | 1.0 | 3.0–3.2 | 4.58 | 0.125 | 0.04 | 0.020 | 16.5 | 1621 |
| | 7 | 1.0 | 3.0–3.2 | 4.48 | 0.120 | 0.04 | 0.021 | 17.5 | 1610 |
| Comparative Example 1 | — | top blowing only | | 4.44 | 0.118 | 0.03 | 0.022 | 20.3 | 1628 |
| Comparative Example 2 | — | 1.0 | — | 4.53 | 0.124 | 0.04 | 0.023 | 19.4 | 1624 |

TABLE 2

| | Run No. | Sequence of Changing the Bottom-Blowing Gas |
|---|---|---|
| Example | 1 | 0 min. $\xrightarrow[N_2]{}$ 4.5 min. $\xrightarrow[O_2]{}$ 5.5 min. $\xrightarrow[N_2]{}$ 10 min. $\xrightarrow[O_2]{}$ 10.5 min. $\xrightarrow[N_2]{}$ 16 min. |
| | 2 | 0 min. $\xrightarrow[O_2]{}$ 0.5 min. $\xrightarrow[N_2]{}$ 7 min. $\xrightarrow[O_2]{}$ 7.3 min. $\xrightarrow[N_2]{}$ 12 min. $\xrightarrow[O_2]{}$ 12.2 min. $\xrightarrow[N_2]{}$ 16 min. |
| | 3 | 0 min. $\xrightarrow[O_2]{}$ 0.4 min. $\xrightarrow[N_2]{}$ 5 min. $\xrightarrow[O_2]{}$ 5.5 min. $\xrightarrow[N_2]{}$ 11.3 min. $\xrightarrow[O_2]{}$ 11.8 min. $\xrightarrow[N_2]{}$ |

TABLE 2-continued

| | Run No. | Sequence of Changing the Bottom-Blowing Gas |
|---|---|---|
| | | 15.4 min. $\xrightarrow{O_2}$ 16 min. |
| | 4 | 0 min. $\xrightarrow{N_2}$ 5.7 min. $\xrightarrow{O_2}$ 5.9 min. $\xrightarrow{N_2}$ 10.3 min. $\xrightarrow{O_2}$ 11.0 min. $\xrightarrow{N_2}$ 16 min. |
| | 5 | 0 min. $\xrightarrow{N_2}$ 9 min. $\xrightarrow{O_2}$ 9.8 min. $\xrightarrow{N_2}$ 14 min. (gas flow rate change) $\xrightarrow{N_2}$ 15.7 min. $\xrightarrow{O_2}$ 16 min. |
| | 6 | 0 min. $\xrightarrow{N_2}$ 9.5 min. $\xrightarrow{O_2}$ 10 min. $\xrightarrow{N_2}$ 14 min. (gas flow rate change) $\xrightarrow{N_2}$ 15.5 min. $\xrightarrow{O_2}$ 15.7 min. $\xrightarrow{N_2}$ 16 min. |
| | 7 | 0 min. $\xrightarrow{N_2}$ 6.0 min. $\xrightarrow{O_2 + N_2}$ 6.6 min. $\xrightarrow{N_2}$ 12.6 min. $\xrightarrow{O_2 + N_2}$ 13.3 min. $\xrightarrow{N_2}$ 16.4 min. |
| Comparative Example 1 | — | no bottom blowing gas |
| Comparative Example 2 | — | The bottom-blowing gas was unchanged (blown at a flow rate of 1.0 $Nm^3$/min. from 0 to 10.1 min., thereafter the flow rate spontaneously decreases, eventually to 0.1 $Nm^3$/min. at 16 min.). |

In all the runs of the above Example, a substantially constant gas flow rate could maintained until the end of blowing without causing nozzle blocking (except Runs Nos. 5 and 6 in which the flow rate was artificially changed between two levels) and no substantial melt-off took place on the tuyere. As seen from Table 1, the iron concentration (T.Fe) of the slag in Example was remarkably reduced as compared with Comparative Example 1 using the top blowing only. In Comparative Example 2, the tuyere nozzle was blocked during blowing and the flow rate of the bottom-blowing gas was reduced to about 10 percent of the initial flow rate at the end of blowing. As a result, the iron concentration (T.Fe) of the slag was not significantly reduced as compared with Comparative Example 1 using the top blowing only. On the other hand, in Runs Nos. 5 & 6, the flow rate of the bottom-blowing gas was set relatively low from the initial to the intermediate stages of blowing and then changed to a level substantially equal to that used in Runs Nos. 1–4 in the final stage of blowing. It was also found in this case that the iron concentration (T.Fe) of a slag was substantially the same as in Runs Nos. 1–4. Accordingly, it was found that this method is effective in reducing both T.Fe and the gas use.

INDUSTRIAL APPLICABILITY

This invention is useful in controlling the bottom-blowing gas in top-and-bottom blown converter steel making, and is particularly effective when a thin tuyere having a diameter of 6 mm or less is used.

We claim:

1. In top and bottom blown converter steel making wherein an oxidizing gas is blown onto the surface of a molten iron in the converter through a lance disposed above the molten iron surface while a bottom blowing gas is blown through at least one single pipe bottom blowing tuyere in the bottom of the converter, a method of controlling the bottom blowing gas for avoiding buildup of iron on the tuyere and burn back of the tuyere, comprising:

detecting the pressure of the bottom blowing gas supplied into said bottom blowing tuyere; and when the bottom blowing gas is an inert gas and the pressure of the inert gas rises and is detected as reaching the upper limit of a predetermined pressure range, changing the gas supplied to the bottom blowing tuyere to an oxidizing gas containing at least 60% of oxygen gas; and when the pressure of the thus supplied oxidizing gas drops and is detected as reaching the lower limit of said predetermined pressure range, changing the gas supplied to the bottom blowing tuyere back to the inert gas, thereby alternately supplying the oxidizing gas and the inert gas to the bottom blowing tuyere.

2. A bottom-blowing gas controlling method according to claim 1 wherein said oxidizing gas for bottom blowing contains at least 80% of oxygen gas.

3. A bottom-blowing gas controlling method according to claim 1 wherein saif bottom-blowing tuyere has an inner diameter of not more than 6 mm.

4. A bottom-blowing gas controlling method according to claim 1 wherein said pressure range is a range of $\pm 0.3$ kg/cm$^2$ or less with respect to a predetermined center value.

* * * * *